US006090497A

United States Patent [19]

Mori et al.

[11] Patent Number: 6,090,497

[45] Date of Patent: Jul. 18, 2000

[54] WEAR-RESISTANT COATED MEMBER

[75] Inventors: Hiroyuki Mori; Kazuyuki Nakanishi; Hideoki Fukushima; Hideo Tachikawa, all of Aichi-ken, Japan

[73] Assignee: Kabushiki Kaisha Toyota Chuo Kenkyusho, Aichi-gun, Japan

[21] Appl. No.: 09/032,068

[22] Filed: Feb. 27, 1998

[30] Foreign Application Priority Data

| | | | |
|---|---|---|---|
| Feb. 28, 1997 | [JP] | Japan | 9-062197 |
| Oct. 6, 1997 | [JP] | Japan | 9-289086 |
| Feb. 18, 1998 | [JP] | Japan | 10-052814 |

[51] Int. Cl.[7] ..... B32B 15/20; C23C 30/00

[52] U.S. Cl. ..... 428/641; 428/650; 428/651; 428/652; 428/937

[58] Field of Search ..... 428/641, 650, 428/651, 652, 653, 654, 937; 420/548, 534, 537, 544, 578

[56] References Cited

U.S. PATENT DOCUMENTS

| | | |
|---|---|---|
| 4,938,810 | 7/1990 | Kiyota et al. . |
| 5,366,691 | 11/1994 | Takeda et al. . |
| 5,405,576 | 4/1995 | Kusui et al. . |
| 5,891,273 | 4/1999 | Ruckert et al. . |

FOREIGN PATENT DOCUMENTS

| | | |
|---|---|---|
| 53-68611 | 6/1978 | Japan . |
| 2-70036 | 3/1990 | Japan . |
| 5-125475 | 5/1993 | Japan . |
| 8-232036 | 9/1996 | Japan . |

*Primary Examiner*—Deborah Jones
*Assistant Examiner*—Jason Savage
*Attorney, Agent, or Firm*—Oblon, Spivak, McClelland, Maier & Neustadt, P.C.

[57] ABSTRACT

A wear-resistant coated member comprising 26 to 80% by weight of silicon (Si), additional components if required and necessary, the remainder being aluminum (Al), and unavoidable impurities, wherein Si is in a fine particle, and has an average particle size in the range of 0.01 to less than 10 $\mu$m, and Al matrix and 3% by weight or more of Si form solid solutions. The wear-resistant coated member has excellent wear resistance and machinability.

9 Claims, 1 Drawing Sheet

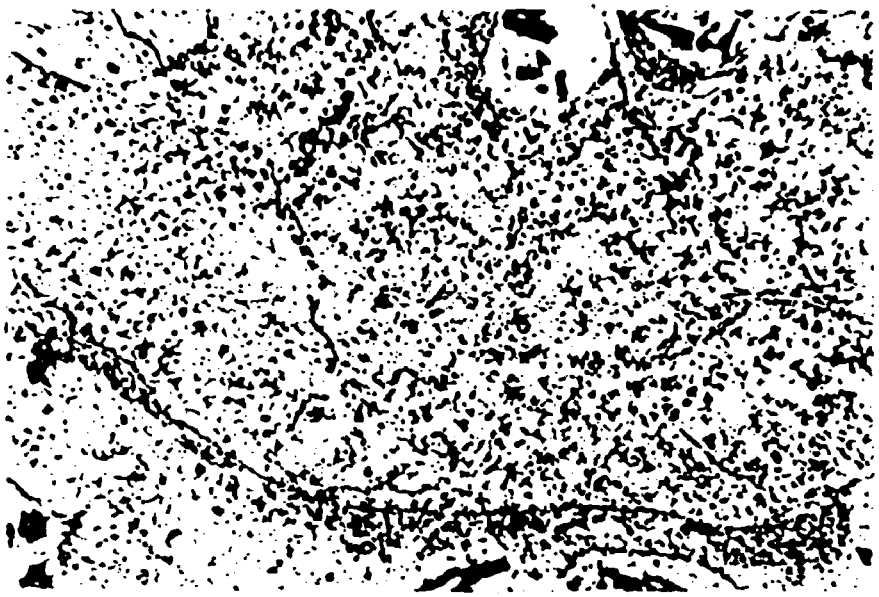
Fig.1(A) Present Invention Product
10 μm
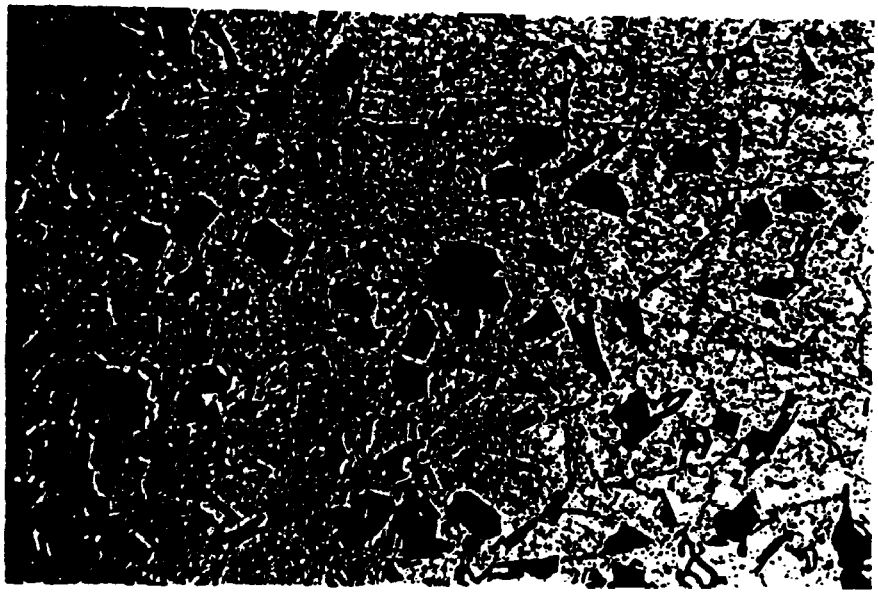
Fig.1(B) Comparative Example Product
25 μm

WEAR-RESISTANT COATED MEMBER

BACKGROUND OF THE INVENTION

1. Field of the Invention

The present invention relates to a wear-resistant coated member. More particularly, the invention relates to a wear-resistant coated member having an aluminum alloy with excellent wear resistance as a coating layer, comprising aluminum (Al) and silicon (Si) as main constituent components, Al matrix and 3% by weight or more of Si form solid solutions, and if required and necessary, further comprising at least one additional component selected from the group consisting of magnesium (Mg), copper (Cu), tin (Sn), lead (Pb); elements of IV group (for example, titanium (Ti), zirconium (Zr), hafnium (Hf)), elements of VA group (for example, vanadium (V), niobium (Nb), tantalum (Ta)), elements of VI group (for example, chromium (Cr), molybdenum (Mo), tungsten (W)), elements of VII group (for example, manganese (Mn)), elements of VIII to X groups (for example, iron (Fe), cobalt (Co), nickel (Ni)), and the like, in the Periodic Table.

2. Description of the Related Art

Conventionally, castings made of Al—Si alloy materials (for example, AC3A, AC8A to C, AC9A to B, or the like) containing about 10 to 20% by weight of Si have been known as products comprising a wear-resistant aluminum alloy material. However, since those aluminum alloys are produced by casting, primary crystal particles of Si which contributes to improvement of wear resistance have considerably large particle size of 20 to 150 $\mu$m, and the amount of Si is not sufficient. As a result, the necessary wear resistance can not be obtained. Further, if Si amount in the alloy material is further increased in order to improve wear resistance of cast products obtained from the alloy materials, casting properties deteriorate, and machinability of cast products are extremely decreased. Thus, there are problems on practical use. For this reason, a powder extrusion method, sintering method, spray coating method, or the like is mainly used in the production of such an alloy in order to obtain Al—Si alloy having an increased Si amount.

Japanese Patent Publication (Laid-open) No. Hei 2-70036 (hereinafter refer to JP-A-) describes a wear-resistant aluminum alloy containing 5 to 35% by weight of Si. This alloy is produced by sintering a starting material powder, (followed by cold press molding and hot press molding), and then hot extrusion. The starting material powder used is a rapidly solidified powder produced by using, for example, a gas atomizing method.

JP-A-53-68611 describes a process for producing an aluminum alloy by spray coating, which comprises a step of spray coating an aluminum alloy having eutectic phase on a substrate at normal temperature or lower, and a step of conducting heat treatment at a temperature at which grain boundary between particles of the spray coated metal disappears, or more. This process yields an aluminum alloy comprising, Si 8 to 25 wt %, Mg 0.1 to 6 wt %, Cu 0.5 to 5 wt %, and the remainder being substantially Al wt %.

Where the powder extrusion method is used, an aluminum alloy having further fine Si particles (average particle size: about 10 $\mu$m) is obtained as compared with the case of using the casting method. However, this aluminum alloy does not have sufficient wear resistance. According to the production process as described in JP-A-2-70036, the production (processing) cost is increased as compared with the casting method. Further, the Si amount in Al—Si alloy is at most 35% by weight, and further increasing the Si amount remarkably impairs the workability.

The spray coating method, for example, as described in JP-A-53-68611, attempts to improve wear resistance by spray coating an aluminum alloy containing about 8 to 25% by weight of Si on a substrate to form a layer having Si solid solution in supersaturation, and heat treating it to precipitate eutectic Si phase finely. However, the aluminum alloy obtained by this process contains a small Si amount, and since the alloy is subjected to heat treatment at 400° C. or more, hardness is decreased. Thus, wear resistance is not sufficient in this alloy. Further, this alloy has various problems on production and also productivity such that heat treatment is necessary after spray coating.

As described above, the aluminum alloy obtained by casting method has a large average particle size of Si, so that a sufficient wear resistance cannot be obtained. Further, the alloy obtained using the conventional spray coating method contains a small Si amount, and the wear resistance cannot be improved unless heat treatment is conducted after spray coating. Even in the aluminum alloy having fine Si particle size obtained using the powder extrusion method, hardness Hv is about 180, and thus the wear resistance is not sufficient.

SUMMARY OF THE INVENTION

As a result of extensive investigations to overcome the problems encountered in the related art techniques, it has been found that in order to secure machinability while attempting high Si formation for improving wear resistance of Al—Si alloy, it is effective that a size of Si fine particles is in the range of 0.01 to less than 10 $\mu$m, and Si is forcedly solid solubilized in Al matrix in an amount of 3% by weight or more, thereby reinforcing solid solubilization. The present invention has been completed based on this finding.

The wear-resistant coated member comprising 26 to 80% by weight of silicon (Si), the remainder being aluminum (Al), and unavoidable impurities, wherein Si is in a fine particle of an average particle size in the range of 0.01 to less than 10 $\mu$m, and Al matrix and 3% by weight or more of Si form solid solutions.

The wear-resistant coated member may further contain other additional components, if required and necessary. The wear-resistant coated member according to the present invention has excellent wear resistance and machinability as described below.

(1) By making high Si formation, volume proportion of Si dispersed particles is increased, and wear resistance and seizing resistance of an alloy itself is greatly improved.

(2) Since Si particle size is fine, wear of a counter material to the wear-resistant coated member is small in sliding. Further, damage of tools in machine processing is less, making grinding and polishing steps easy, and as a result, machinability is improved.

(3) Due to a synergistic effect of (1) and (2) above, a material having low friction coefficient is obtained.

(4) Al matrix and 3% by weight or more of Si form solid solution, so that hardness is increased and wear resistance is improved (solid solution hardening).

BRIEF DESCRIPTION OF THE DRAWINGS

FIG. 1 (A) and FIG. 1 (B) are microphotographs showing metal structure of the wear-resistant coated member of the present invention and a wear-resistant aluminum alloy of the comparative example respectively.

DETAILEED DESCRIPTION OF THE PREFERRED EMBODIMENT

It is preferable in the wear-resistant coated member of the present invention that additional component other than silicon is one or two elements selected from the group consisting of 0.05 to 10% by weight of magnesium (Mg) and 0.5 to 10% by weight of copper (Cu).

It is more preferable in the wear-resistant coated member of the present invention that the additional component other than silicon is one or two elements selected from the group consisting of tin (Sn) and lead (Pb) in an amount of 0.1 to 20% by weight in addition to Mg and Cu.

Further, it is preferable in the wear-resistant coated member of the present invention that the additional component other than silicon is at least one element selected from the group consisting of Group IV to Group X. Of the above elements of Groups IV to VIII, elements of Group IV are preferably titanium (Ti), zirconium (Zr) and hafnium (Hf), elements of Group V are preferably vanadium (V), niobium (Nb) and tantalum (Ta), elements of Group VI are preferably chromium (Cr), molybdenum (Mo) and tungsten (W), elements of Group VII are preferably manganese (Mn), and elements of Group VIII to Group X are preferably iron (Fe), cobalt (Co) and nickel (Ni), respectively, in consideration of cost.

[Additional Components of Wear-Resistant Coated Member]

Function of each component element of the wear resistant, coated member of the present invention and reason for the limitation of the value of the content range thereof are explained below.

1. Silicon

The conventional wear-resistant aluminum alloy has large Si particle size (about 10 μm in powder extrusion products, several tens μm in cast products), and the wear resistance is not sufficient. The wear-resistant coated member of the present invention is that Si is fine particle, an average particle size thereof is in the range of 0.01 to less than 10 μm, and Al matrix and 3% by weight or more of Si form solid solutions by, for example, quenching effect at the time of production, so that hardness is improved and wear resistance is also improved. Further, if the wear-resistant coated member of the present invention is used as a sliding member, attack property to the counter material is small. By increasing a cooling rate in producing the wear-resistant coated member of the present invention, crystallization of primary crystal Si in an equilibrium state is inhibited where the Si content is small. As a result, wear resistance of the alloy is not sufficient. If the Si content is 26% by weight or more, primary crystal Si is crystallized in a sufficient volume amount to the entire alloy, and as a result, wear resistance of the alloy is improved. On the other hand, if the Si content exceeds 80% by weight, attack property to the counter material becomes large to exceed the allowable limit when the alloy is used as a sliding member.

2. Magnesium and Copper

By reinforcing solid solution and precipitation of aluminum base, those components magnesium and/or copper serve to improve mechanical properties of alloy. By this, hardness of alloy is improved, and also falling down of fine Si in sliding is prevented. If those contents are less than 0.05% by weight, reinforcing effect is small, and if those contents exceed 10% by weight, alloy becomes brittle.

3. Tin and Lead

Those components tin and/or lead serve to improve machinability of alloy. If the content thereof is less than 0.1% by weight, improvement in machinability is not expected, and on the other hand, if it exceeds 20% by weight, it rather decreases strength and wear resistance of alloy.

4. Elements of Groups IV to X (titanium, zirconium, hafnium vanadium, niobium, tantalum, chromium, molybdenum, tungsten, manganese, iron, cobalt and nickel)

Those elements serve to improve strength of aluminum base. Elements of Groups IV to X have slow diffusion rate in aluminum matrix, and therefore, heat resistance of alloy is markedly improved. If the sum of those elements is less than 0.05% by weight, effect of improving strength is small, and on the other hand, if it exceeds 15% by weight, alloy becomes brittle. It is preferable that the sum of additional components excluding silicon does not exceed 15% by weight.

[Production Method of Wear Resistant, Coated Member]

Production method of the wear-resistant coated member of the present invention is explained below.

Si has high hardness (Hv 1000), and has wear resistance by itself, but is brittle. Si is liable to break in cutting or sliding. If broken, Si particles unfavorable promote abrasion of the counter material such as tools or the like. Therefore, in order to have high wear resistance and to obtain workability such as cutting property, it is important that Si and Al matrix form solid solutions in high Si amount as a composition in alloy, thereby reinforcing the solid solutions, and Si particles become fine. If Si particles have an average particle size of 10 μm or more, Si particles in alloy unfavorably accelerate abrasion of a counter material such as tools or the like. Therefore, there are problems in the use of such an alloy. On the other hand, if Si particles have an average particle size of less than 0.01 μm, wear resistance of alloy itself is decreased, and adhesion properties of the alloy to a counter material are increased. Therefore, this is the problem when such an alloy is used. The average particle size of Si particles in alloy is preferably 0.01 to less than 3 μm. Within this range, the alloy can suppress abrasion of a counter material, and wear resistance of the alloy itself can markedly be improved.

For the reasons described above, it is necessary in the wear- resistant coated member of the present invention that Si is in a fine particle, its average particle size is 0.01 to less than 10 μm, and Al matrix and 3% by weight or more of Si form solid solutions. A preferable method for obtaining such an alloy is, for example, melting raw material alloys having predetermined compositions, and then cooling the resulting melt at a cooling rate exceeding gas cooling rate, that is, a cooling rate corresponding to solid cooling rate, by controlling the cooling rate. This method enables Si to convert to fine particles thereof and also Al matrix and 3% by weight or more of Si to form solid solutions. The upper limit of the Si solid solution amount is appropriately determined considering balance between the amount of Si fine particles and the amount of Si solid solution. More specifically, the wear-resistant coated member of the present invention is obtained by, for example, melting raw material alloy comprising 26 to 80% by weight, and preferably 36 to 70% by weight of silicon (Si), the remainder being aluminum (Al), and unavoidable impurities, and if required and necessary, further comprising additional components, cooling the resulting melt at solid cooling rate by controlling cooling rate, whereby Si fine particles in the alloy have an average particle size in the range of 0.01 to less than 10 μm, and preferably 0.01 to less than 3 μm, and Al matrix and 3% by weight or more of Si form solid solutions.

If the cooling rate is fast, time that Si crystalized particles grow is short, and Si forms in fine particles. Therefore, if a cooling method which can obtain a cooling rate comparable to solid cooling rate, faster than gas cooling is used, an alloy is obtained, in which Si is in finer particles as compared with the conventional alloy, and Si is solid solubilized in Al matrix in an amount of 3% by weight or more.

Specifically, if a method such as spray coating method or laser clad method is used, the wear-resistant coated member of the present invention with high silicon content and silicon fine particles can easily be obtained. In general, where conventional gas atomizing method is used, gas cooling rate is $10^2 \times 10^{4°}$ C./sec, but in a method such as spray coating method or laser clad method, cooling rate of $10^{5°}$ C./sec or more comparable to solid cooling is obtained.

In those production methods, it is general that suitable raw material alloy, for example, raw material alloy powder is melt, and then cooled on a solid. That is, the spray coating method comprises melting raw material alloy powder, and adhering the resulting melt on a substrate to form a film, and the laser clad method comprises directly coating or spray coating raw material alloy powder on a substrate to once coat the desired site, and melting it with laser to pad thereon.

If a metal material having large heat conductivity is used as the substrate in the above methods, cooling rate of molten alloy is increased. Therefore, substrates comprising metal materials such as copper, aluminum or iron are preferable. It is better to form mechanical grinding-processed surface or polished surface on the substrate as a pretreatment. In the spray coating method, in order to secure adhesion it is better to form a sprayed film on a mechanical grinding processed surface which was blast treated.

Where a substrate comprising a material having small heat conductivity, such as ceramics, is used, it is necessary to increase cooling rate of molten alloy (for example, cooling a substrate and/or an atmosphere with an appropriate method; using a substrate previously cooled; or the like).

If thermal expansion between the substrate and the coating layer differs, troubles such that separation of the coating layer may occur where a member is used under environment which receives heat cycle after coating treatment or during use. It is an effective means in this case on prevention of the above troubles to form a coating layer having gradient composition in which compositional ratio of silicon in the coating layer is controlled.

That is, if silicon amount in the coating layer of the wear-resistant coated member of the present invention is large, coefficient of thermal expansion becomes relatively small. Utilizing this fact, the silicon amount in the coating layer in the vicinity of the substrate may be changed so as to approach coefficient of thermal expansion of the substrate used.

The wear-resistant coated member of the present invention formed by spray coating method or laser clad method is finished into a mechanical grinding processed surface or polished surface, and is used as sliding parts (for example, compressor parts, engine parts or bearing materials) of automobiles, or machine parts. The average particle size of Si fine particles in the wear-resistant coated member of the present invention can be measured by, for example, observing a mirror-polished surface of an alloy with optical microscope or scanning electron microscope of high magnification (×1000 or more), forming an image of the result, and analyzing the result. Further, solid solution proportion of Si in Al matrix in the coating layer of the wear-resistant coated member of the present invention was determined by X ray intensity ratio (X ray intensity of Si/X ray intensity of Al) or image analysis of metal structure.

The present invention is described in more detail by reference to the following examples and comparative examples, but the invention is not limited thereto.

I. Production of Aluminum Alloy (a) Plasma spray coating method

Raw material alloy powder was prepared by gas atomizing method, and was coated on A2017 aluminum alloy substrate with plasma spray coating method to form a film having a thickness of 0.3 mm, thereby preparing wear-resistant coated member (alloy) of the present invention and wear-resistant aluminum alloy of comparative examples.

(b) Casting method

Raw material alloy was subjected to permanent mold casting to produce alloys of comparative examples.

(c) Powder extrusion method

Raw material alloy powder was molded, hot-extruded at about 500° C., and subjected to aging to improve hardness, thereby producing alloys of comparative examples. Compositions of each alloy are shown in Table 1. Sample Nos. 1, 2, 4 and 4' are alloys of comparative examples having less Si content as compared with the composition of the wear-resistant coated member of the present invention.

Sample Nos. 7 to 17 are wear-resistant coated members of the present invention.

Sample No. 18 is an alloy of comparative example having larger Si content as compared with the wear-resistant coated member of the present invention.

Sample Nos. 7', 7", 8', 9', 10' and 12' are alloys of comparative examples having compositions equal to those of the wear-resistant coated member of the present invention, respectively.

TABLE 1: Aluminum Alloy Composition (% by Weight)

TABLE 1

| Sample No. | Alloy | Si | Mg | Cu | Sn | Pb | Ti | Zr | V | Cr | Mo | Mn | Fe | Ni | Al |
|---|---|---|---|---|---|---|---|---|---|---|---|---|---|---|---|
| 1 | a | 8 | 1 | 4 | 0 | 0 | 0 | 0 | 0 | 0 | 0 | 0 | 0 | 0 | Remainder |
| 2 | b | 12 | 1 | 4 | 0 | 0 | 0 | 0 | 0 | 0 | 0 | 0 | 0 | 0 | Remainder |
| 4 | c | 17 | 0.5 | 5 | 0 | 0 | 0 | 0 | 0 | 0 | 0 | 0 | 0 | 0 | Remainder |
| 4' | d | | | | | | | | | | | | | | |
| 7 | e | 26 | 2 | 3 | 0 | 0 | 2 | 0 | 0 | 0 | 0 | 0 | 0 | 0 | Remainder |
| 7' | f | | | | | | | | | | | | | | |
| 7" | g | | | | | | | | | | | | | | |
| 8 | h | 30 | 0 | 5 | 0 | 0 | 0 | 1 | 0 | 0 | 0 | 0 | 0 | 0 | Remainder |
| 8' | i | | | | | | | | | | | | | | |
| 9 | j | 36 | 0 | 0 | 0 | 0 | 0 | 0 | 5 | 0 | 0 | 0 | 0 | 0 | Remainder |
| 9' | k | | | | | | | | | | | | | | |
| 10 | l | 40 | 1 | 4.5 | 0 | 0 | 0 | 0 | 0 | 5 | 3 | 0 | 0 | 0 | Remainder |
| 10' | m | | | | | | | | | | | | | | |
| 11 | n | 40 | 0.5 | 3 | 3 | 6 | 0 | 0 | 0 | 0 | 0 | 0 | 0 | 0 | Remainder |
| 12 | o | 40 | 0 | 0 | 0 | 0 | 0 | 0 | 0 | 0 | 0 | 5 | 0 | 0 | Remainder |
| 12' | p | | | | | | | | | | | | | | |
| 13 | q | 40 | 0 | 0 | 0 | 0 | 0 | 0 | 0 | 0 | 0 | 0 | 10 | 0 | Remainder |

TABLE 1-continued

| Sample No. | Alloy | Si | Mg | Cu | Sn | Pb | Ti | Zr | V | Cr | Mo | Mn | Fe | Ni | Al |
|---|---|---|---|---|---|---|---|---|---|---|---|---|---|---|---|
| 14 | r | 50 | 0 | 0 | 0 | 0 | 0 | 0 | 0 | 0 | 0 | 0 | 0 | 12 | Remainder |
| 15 | s | 60 | 0.3 | 5.5 | 0 | 0 | 2 | 0 | 0 | 0 | 0 | 0 | 5 | 0 | Remainder |
| 16 | t | 60 | 1 | 4 | 0 | 0 | 0 | 0 | 0 | 3 | 0 | 0 | 0 | 0 | Remainder |
| 17 | u | 75 | 1 | 2.5 | 10 | 0 | 0 | 0 | 0 | 0 | 0 | 0 | 0 | 0 | Remainder |
| 18 | v | 85 | 1 | 1 | 0 | 0 | 0 | 0 | 0 | 0 | 0 | 0 | 0 | 0 | Remainder |

In Table 1, a to v show the following embodiments.
a: Comparative example (P)
b: Comparative example (P)
c: Comparative example (C)
d: Comparative example (P)
e: Present invention (P)
f: Comparative example (C)
g: Comparative example (PW)
h: Present invention (P)
i: Comparative example (PW)
j: Present invention (P)
k: Comparative example (PW)
l: Present invention (P)
m: Comparative example (PW)
n: Present invention (P)
o: Present invention (P)
p: Comparative example (PW)
q: Present invention (P)
r: Present invention (P)
s: Present invention (P)
t: Present invention (P)
u: Present invention (P)
v: Comparative example (P)

Further, in each sample above, (P) expresses an alloy prepared by a plasma spray coating method; (C) expresses an alloy prepared by a casting method; and (PW) expresses an alloy prepared by a powder extrusion method.

II. Wear Resistance Evaluation Test 1

Wear resistance evaluation test was conducted on each of test pieces formed using various production processes.

A) Preparation of Test Piece

1) Plasma spray coating method

Aluminum alloy having predetermined compositions was formed into a film having a thickness of 0.3 mm by a plasma spray coating method, the resulting film was polished to have a surface roughness Rz of 1.0 $\mu$m or less, and evaluation of wear resistance was conducted.

2) Casting method

Aluminum alloy having predetermined compositions was produced by a casting method, the alloy was polished in the same manner as in the plasma spray coating method, and evaluation of wear resistance was conducted.

3) Powder extrusion method

Aluminum alloy having predetermined compositions was produced by a powder extrusion method, the alloy was polished in the same manner as in the plasma spray coating method, and evaluation of wear resistance was conducted.

B) Evaluation of Wear Resistance

Ball on disk test was used as an evaluation method of wear resistance. The wear-resistant coated member of the present invention or the alloy of comparative example was used at the disk side, and a bearing steel SUJ2 was used at the ball side. The maximum wear depth of disk was evaluated as a measure of wear resistance, and a wear diameter at the ball side was evaluated as a measure of attack property to a counter material.

C) Result

Results of wear resistance test obtained using Sample Nos. 4, 4', 7, 7', 7", 10, 10', 12 and 12' in Table 1 are shown in Table 2. The cast product of Sample No. 7' had blow hole or defect in the inside of its test piece, and could not be tested. Therefore, comparison was made using four plasma spray coated products of Sample Nos. 4', 7, 10 and 12 and the cast products of Sample No. 4 and three powder extrusion products of Sample Nos. 7", 10' and 12'.

TABLE 2: Wear Resistance (Results of Wear Resistance Characteristics)

TABLE 2

| Sample No. | Production method | Wear depth of disk ($\mu$m) | Wear diameter of ball (mm) | Average particle size of Si ($\mu$m) | Solid Solubilized proportion of Si in Al matrix (wt %) | Vickers hardness Hv (100 g) |
|---|---|---|---|---|---|---|
| 4 | Comparative Example (C) | 25 | 1.2 | 20 | — | 120 |
| 4' | Comparative Example (P) | 8 | 1.0 | 0.1 | — | 190 |
| 7 | Present Invention (P) | 4 | 0.9 | 0.1 | 16 | 230 |
| 7' | Comparative Example (C) | 20 | 1.4 | 40 | — | 140 |
| 7" | Comparative Example (PW) | 14 | 1.1 | 5 | 1.5 | 170 |
| 10 | Present Invention (P) | 1 | 0.3 | 0.5 | 12 | 300 |
| 10' | Comparative Example (PW) | 13 | 1.4 | 6 | 1.0 | 180 |
| 12 | Present Invention (P) | 5.5 | 0.8 | 0.6 | 11.6 | 200 |
| 12' | Comparative Example (PW) | 40 | 1.5 | 7 | 1.5 | 140 |

As is apparent from Table 2, the present invention products wherein a plasma spray coating method was applied to raw material alloys of Sample Nos. 7, 10 and 12 have small Si particle size (average Si particle size), small disk wear depth and small ball wear diameter. Contrary to this, the comparative example product wherein a casting method was applied to raw material alloys of Example No. 4 has very large Si particle size, very large disk wear depth and also very large ball wear diameter, as compared with the present invention products. Further, the comparative example products wherein a powder extrusion method was applied to raw material alloys of Sample Nos. 7", 10' and 12' have large Si particle size and very large disk wear depth, as compared with the present invention products.

It is therefore understood that the present invention products are that wear resistance is high (disk wear depth is small), and attack property to a counter material is low (ball wear diameter is small).

Microphotographs of metal structure of the wear resistant coated member of the present invention and the wear resistance aluminum alloy of the comparative example are shown in FIG. 1 (A) and FIG. 1 (B). FIG. 1(A) is a microphotograph of metal structure of the present invention product of sample No. 10 obtained using a plasma spray coating method and FIG. 1(B) is a microphotograph of metal structure of the comparative example product of sample No. 4 obtained using a casting method. In the comparative example product of FIG. 1(B), an average particle size of primary crystal of Si is large as 20 $\mu$m. On the other hand, in the present invention product of FIG. 1(A), an average particle size of Si is 0.5 $\mu$m, which clearly shows that the average particle size is very small as compared with the comparative example product. An average particle size of Si in Sample Nos. 7 to 17 of the present invention was in the range of 0.01 to less than 10 $\mu$m.

III. Wear Resistance Evaluation Test 2

Sample Nos. 1, 2 and 18 which are the comparative example products in Table 1 and Sample Nos. 10, 11, 13, 14, 15, 16 and 17 which are the present invention products were used, and results of wear test of the coating formed by plasma spray coating are shown in Table 3.

TABLE 3: Wear Resistance (Results of Wear Resistance Characteristics)

TABLE 3

| Sample No. | Production method | Wear depth of disk ($\mu$m) | Wear diameter of ball (mm) |
|---|---|---|---|
| 1 | Comparative example (P) | 16 | 1.2 |
| 2 | Comparative example (P) | 12 | 1.1 |
| 10 | Present Invention (P) | 1.0 | 0.3 |
| 11 | Present Invention (P) | 2.5 | 0.5 |
| 13 | Present Invention (P) | 2.0 | 0.8 |
| 14 | Present Invention (P) | 2.0 | 0.6 |
| 15 | Present Invention (P) | 2.0 | 0.7 |
| 16 | Present Invention (P) | 2 | 0.7 |
| 17 | Present Invention (P) | 4.0 | 1.0 |
| 18 | Comparative Example (P) | 18 | 1.6 |

As is apparent from Table 3, alloys (Sample Nos. 1 and 2) having Si content lower than Si content of the wear-resistant coated member of the present invention and an alloy (Sample No. 18) having Si content higher than that of the wear-resistant coated member of the present invention show large disk wear depth (low wear resistance) and also large ball wear diameter (high attack property to a counter material), as compared with the wear-resistant coated member of the present invention.

Contrary to this, the wear-resistant coated members of the present invention are that disk wear depth was small, ball wear diameter was small, and wear resistance and attack property to a counter material were good. Further, it is seen that the wear-resistant coated members of the present invention further containing Mg, Cu, Mn, Fe, Ni, Cr, Mo and/or Ti have solid solution hardening to aluminum base, and itis also seen that the above wear-resistant coated members of the present invention further containing Sn and/or Pb have improved machinability, and due to having high Si content, wear resistance and attack property to a counter material are good.

Heat Resistance Evaluation Test

Sample No. 4 which is the comparative example product inTable 1 and Sample Nos. 10 and 11 which are the present invention products in Table 1 were used, and hardness where heating time was constant (1 hour) and heating temperature was changed was examined. The results obtained are shown in Table 4.

TABLE 4: Change in Hardness (Hv) of the Coating where Heating Temperature was Changed

TABLE 4

| Sample No. | Production method | Room temperature (before heating) | Heating temperature (° C.) 250 | 300 | 350 |
|---|---|---|---|---|---|
| 4 | Comparative Example (C) | 145 | 100 | 85 | 80 |
| 10 | Present Invention (P) | 300 | 305 | 310 | 305 |
| 11 | Present Invention (P) | 260 | 265 | 265 | 220 |

As is apparent from Table 4, Sample Nos. 10 and 11 which are the present invention products show that decrease in hardness is small even if exposed to high temperature, and heat resistance is excellent, as compared with Sample No. 4 which is the comparative example product. Further, when Sample No. 10 and Sample No. 11 are compared, Sample No. 10 shows high heat resistance, and it is seen from this fact that the present invention products having Cr and Mo of Group VI in the Periodic Table have further excellent heat resistance in the present invention products. This effect is not limited to the case of adding elements of Group VI of the Periodic Table, but is also obtained in the case that elements of Group IV to Group X (other than elements of Group VI) of the Period Table are added.

If the wear-resistant coated member of the present invention is used, wear resistance and machinability of various machine parts can greatly be improved as illustrated below.

(1) Due to high Si formation, volume proportion of Si dispersed particles is increased, and wear resistance or heat-resistance of alloy itself can greatly be improved.

(2) Since Si particle size is fine, wear of a counter material in sliding is small. Further, damage of tools is less in cut processing, and cut powder formed in cutting is fine, making cutting and polishing steps easy. Thus, machinability is improved.

(3) By the synergistic effect of (1) and (2) above, material having low friction coefficient is obtained.

(4) Due to that Al matrix and 3% by weight or more of Si form solid solutions, hardness is increased, and wear resistance is improved (solid solution hardening).

What is claimed is:

1. A wear-resistant coated member wherein the coating consists essentially of 26 to 80% by weight of silicon (Si), the remainder being aluminum (Al) as a matrix, and unavoidable impurities, wherein Si is in a form of fine particles having an average particle size in the range of 0.01 to less than 10 $\mu$m, and the Al matrix and 3% by weight or more of Si in a form of solid solutions.

2. The wear-resistant coated member as claimed in claim 1, wherein the Si content is 36 to 70 wt %.

3. The wear-resistant coated member as claimed in claim 1, wherein an average diameter of Si particles is within the range of 0.01 μm to less than 3 μm.

4. A wear-resistant coated member wherein the coating consists essentially of 26 to 80% by weight of silicon (Si), at least one of 1) 0.05 to 15 wt % of at least one element selected from the group consisting of group 4, 5, 6, 7, 8, 9 and 10 of the Periodic Table, 2) 0.05 to 10 wt % of Mg, and 3) 0.5 to 10 wt % of Cu, the remainder being an aluminum matrix, and unavoidable impurities, wherein Si is in a form of fine particles having an average particle size in the range of 0.01 to less than 10 μm, and the aluminum matrix and 3% by weight or more of Si in a form of solid solutions.

5. The wear-resistant coated member as claimed in claim 4, wherein the Si content is 36 to 70 wt % of Si.

6. The wear-resistant coated member as claimed in claim 4, wherein an average diameter of Si particles is within the range of 0.01 μm to less than 3 μm.

7. A wear-resistant coated member wherein the coating consists essentially of 26 to 80% by weight of silicon (Si), 0.05 to 15 wt % of at least one element selected from the group consisting of group 4, 5, 6, 7, 8, 9 and 10 of the Periodic Table, the remainder being an aluminum matrix, and unavoidable impurities, wherein Si is in a form of fine particles having an average particle size in the range of 0.01 to less than 10 μm, and the aluminum matrix and 3% by weight or more of Si in a form of solid solutions.

8. A wear-resistant coated member wherein the coating consists essentially of 26 to 80% by weight of silicon (Si), 0.05 to 10 wt % of Mg, the remainder being an aluminum matrix, and unavoidable impurities, wherein Si is in a form of fine particles having an average particle size in the range of 0.01 to less than 10 μm, and the aluminum matrix and 3% by weight or more of Si in a form of solid solutions.

9. A wear-resistant coated member wherein the coating consists essentially of 26 to 80% by weight of silicon (Si), 0.5 wt % of Cu, the remainder being a aluminum matrix, and unavoidable impurities, wherein Si is in a form of fine particles having an average particle size in the range of 0.01 to less than 10 μm, and the aluminum matrix and 3% by weight or more of Si in a form of solid solutions.

* * * * *